US006837641B2

(12) United States Patent
Paul

(10) Patent No.: US 6,837,641 B2
(45) Date of Patent: Jan. 4, 2005

(54) SECURABLE WRITING APPARATUS AND METHOD FOR NOTEBOOKS

(76) Inventor: Christophor P. Paul, 4314 Mission Ct., Alexandria, VA (US) 22310

( * ) Notice: Subject to any disclaimer, the term of this patent is extended or adjusted under 35 U.S.C. 154(b) by 0 days.

(21) Appl. No.: 10/725,487

(22) Filed: Dec. 3, 2003

(65) Prior Publication Data

US 2004/0197763 A1 Oct. 7, 2004

Related U.S. Application Data

(60) Provisional application No. 60/430,655, filed on Dec. 4, 2002.

(51) Int. Cl.[7] ..... B42F 13/40
(52) U.S. Cl. ..... 402/4
(58) Field of Search ..... 434/408, 411, 434/433; 402/4, 79; 281/28, 30, 37, 38

(56) References Cited

U.S. PATENT DOCUMENTS 2,160,392 A * 5/1939 Schade ..... 402/4
2,184,823 A * 12/1939 Vernon ..... 402/4
2,821,197 A * 1/1958 Bilbrey ..... 402/4
3,126,891 A * 3/1964 Caputi ..... 402/31
4,075,702 A * 2/1978 Davies ..... 708/106
4,244,660 A * 1/1981 Aronson ..... 402/79
5,498,089 A * 3/1996 Motyka ..... 402/4
5,695,294 A * 12/1997 Bedol et al. ..... 402/79
6,113,297 A * 9/2000 Kovacik ..... 402/4

* cited by examiner

*Primary Examiner*—Kurt Fernstrom
(74) *Attorney, Agent, or Firm*—Bradford Kile; Scott Houtteman; Kile Goekjian Reed & McManus PLLC

(57) ABSTRACT

A securable writing apparatus and method for notebooks that includes a body portion of a securable writing apparatus, such as for example, a pen, a first attachment member connected to the pen and a second attachment member connected to the pen. The attachment members may be operably carried by the writing instrument or the notebook or a combination thereof.

5 Claims, 6 Drawing Sheets

SECURABLE WRITING APPARATUS AND METHOD FOR NOTEBOOKS

PROVISIONAL APPLICATION

This application claims the benefit of U.S. Provisional Application No. 60/430,655 entitled "Securable Writing Apparatus for Notebooks" as filed on Dec. 4, 2002.

FIELD OF THE INVENTION

This invention relates to an improvement for writing instruments and method for attachment to a notebook. More specifically, this invention relates to a writing instrument and method that is operable to be securely but selectively coupled with a notebook or the like.

BACKGROUND OF THE INVENTION

Writing instruments have been in use for centuries, becoming more dependable, longer lasting, and more economical over the years. Moreover, writing implements are often adapted to the media in which they are to be primarily used. A common problem with writing devices is that they are easily lost or inadvertently destroyed. A user of a writing apparatus, such as a pen, usually carries the writing instrument in a pocket or holder or clipped to notebook paper pages or other media on which it is to be used.

The prior art contains various embodiments of devices or designs used to secure writing implements along with the media in which it is to be used. Furthermore, the prior art teaches securing writing units by using rings and/or holes attached to or fashioned within a writing device. However, the prior art does not contain a writing apparatus that is securable to a ring binding or spiral binding in common bound notebooks, using multiple holes or fastening devices for enhancing the security of the apparatus with respect to the notebook and minimizing interference with the contents and/or normal operation of a notebook.

One embodiment of the subject invention is designed to clip a writing device securely into a ring binder for convenient storage and accessibility. Instead of a pocket clip attached on the cap of a pen or other writing implement, a cap for a writing apparatus can have a flat segment with a hole fashioned through it that extends out from the portion of the cap that covers the main body of the writing apparatus. A similar flat segment, with a second hole fashioned into it, extends out from the main body of the apparatus. The distance between the two holes of the flat segments, when the cap is secured to the main body of the writing apparatus, is approximately the same as the distance common in spacing between rings of a two-ring or three-ring binder. This allows the pen or other writing apparatus to be clipped into a binder without a special storage case for the pen or writing apparatus. The pen or writing apparatus is operable to be facilely removed from its cap for use. However, one significant advantage of this embodiment of the subject invention is that the cap does not have to be removed from the binder. This prevents losing the cap, which is not an uncommon occurrence, and, likewise, prevents losing the writing apparatus when the writing apparatus is secured into the cap. Further, the main body of the writing apparatus can be concomitantly secured to the notebook and cap, providing extra security. Another advantage is that the writing apparatus provides its own storage within the binder as opposed to buying a special storage case. A further advantage of the subject invention is the respective flattened segments of the cap and main body of the writing apparatus which allows the writing apparatus to be secured without having to interpose the main body of the writing apparatus between the pages of the notebook.

Another embodiment of the subject invention is a writing apparatus that has a securing device formed as a clasp or generally C-shaped retaining member. This embodiment of the invention permits a writing apparatus and/or a cap of a writing apparatus to be secured within metal rings of a spiral bound notebook, or some other spiral bound apparatus. The clip of this embodiment are designed to be positioned to extend away from the main body of the writing apparatus, to facilitate less intrusive storage with respect to the bound materials. For example, a pen with a cap having a clasp, as well as the main body having a similar clasp, can be secured to a spiral bound notebook by moving the respective clasp so that there is an opening. This allows the binding to be placed inside the hole. Then, by moving the clasp to a position where there is no longer an opening, the apparatus and/or cap is secured to the binding. The writing apparatus in its secured position can be stowed within the binding.

Another embodiment of the present invention is a writing apparatus where the securing devices are both connected to the main body of the writing apparatus and extend away from the main body. The securing devices of this embodiment of the subject invention can be a completely closed hole, a clasp or a generally C-shaped retaining member. The securing devices in this embodiment are connected to the writing apparatus itself, as opposed to one of the securing devices being affixed to a cap that is fitted on and separable from the writing portion of the apparatus. Additionally, this embodiment allows the writing apparatus to have a retractable cartridge and eliminates the necessity for a cap.

BRIEF DESCRIPTION OF THE DRAWINGS

Other aspects and advantages of the present invention will become apparent from the following detailed description of preferred embodiments taken in conjunction with the accompanying drawings wherein.

DETAILED DESCRIPTION

Figure 1B:
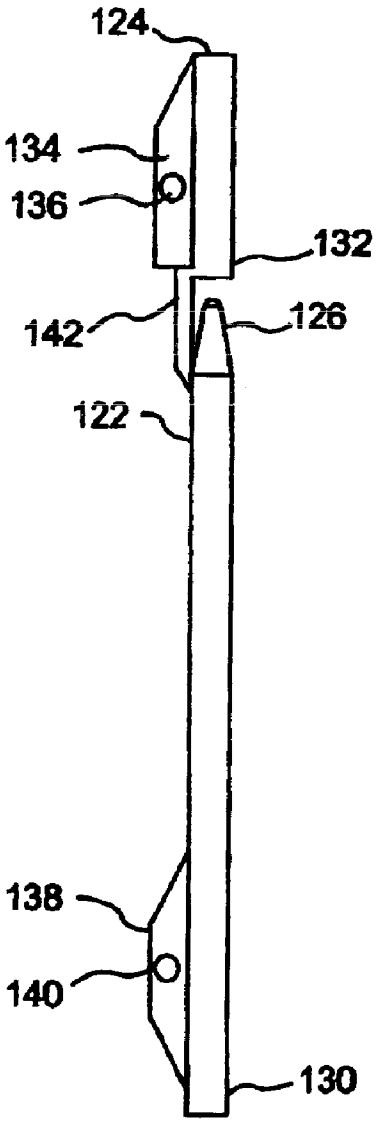
FIG. 1B illustrates a writing apparatus similar to FIG. 1A having a cap with a flattened segment connected to, and extending from, the cap, and a similar flattened segment connected to, and extending from, the main body of the writing apparatus, each segment containing a hole for securing the writing apparatus into a ring binder.
Figure 1A:
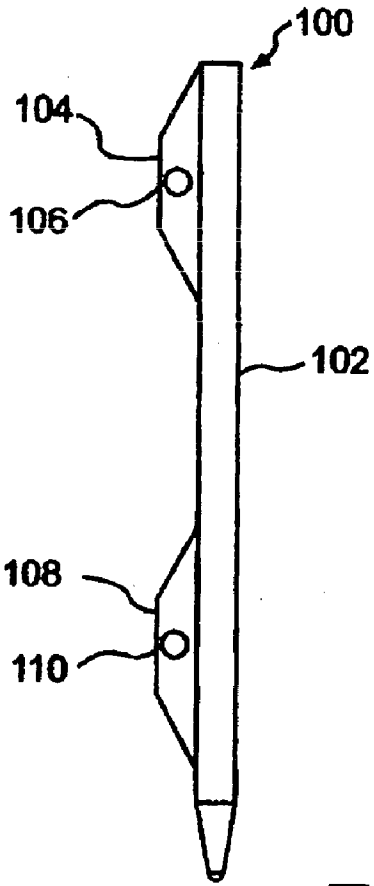
FIG. 1A illustrates a writing apparatus such as a pen in accordance with one embodiment of the invention having a first and second flattened segment connected to, and extending from, a body portion of the pen wherein each segment contains a hole for securing the pen into a ring binder.

Turning now to the drawings wherein like numerals indicate like parts, FIG. 1A discloses a writing apparatus or pen 100 which is shown having two flattened segments 104 and 108 connected to, and extending from, the main body 102 of the pen. The flattened segments are in the shape of trapezoids with the base portion integrated into the cylindrical body of the pen. The trapezoidal segments 104 and 108 are similar is dimension and each is fashioned with a hole 106 and 110 respectively. The holes 106 and 110 allow the main body of the pen to be releasably secured within a ring bound notebook by opening the binding, placing the holes 106 and 110 around two adjacent rings of the binding, and then closing the binding.

Figure 5:
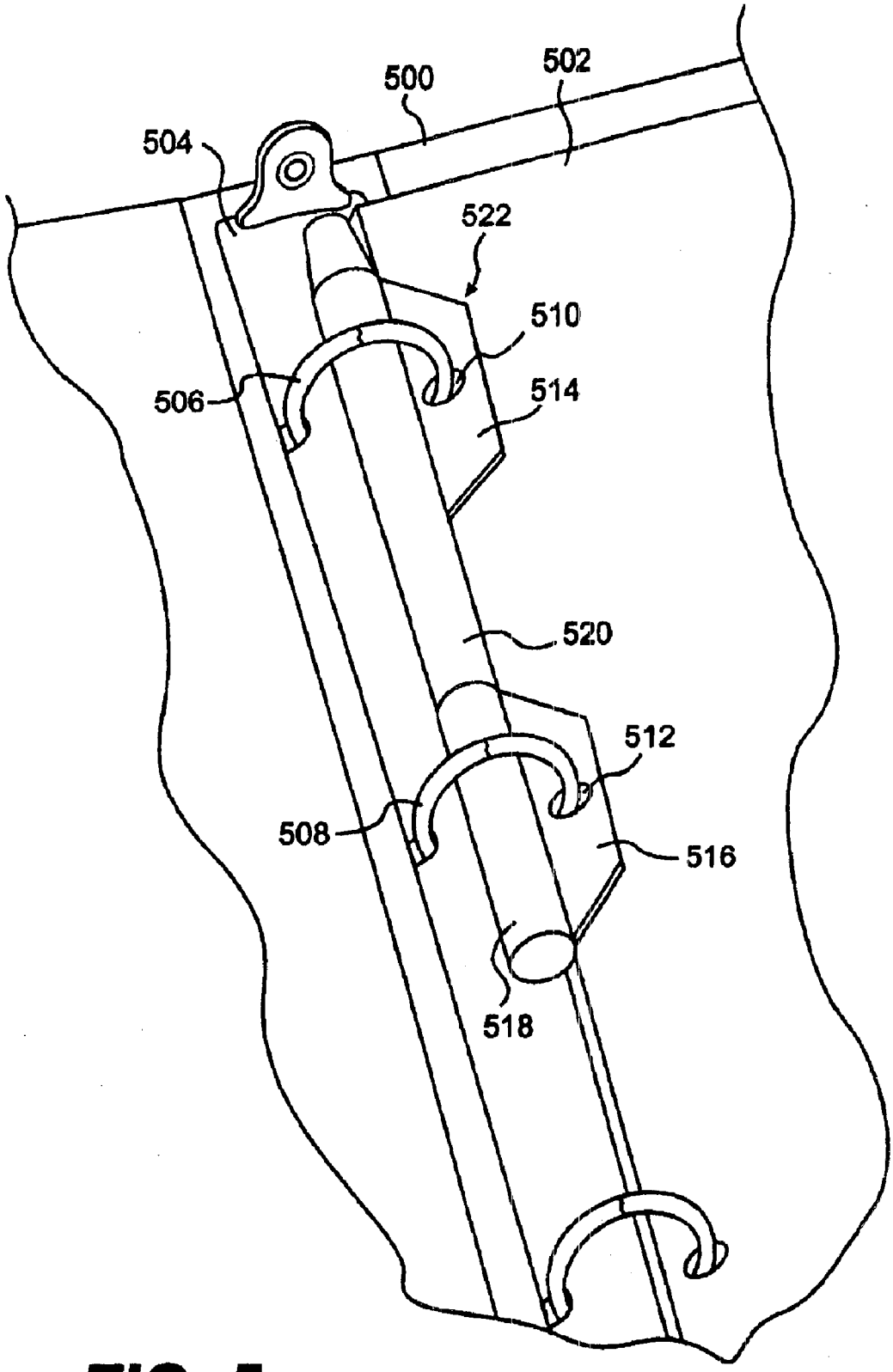
FIG. 5 illustrates a pen such as illustrated in FIGS. 1A and 1B releasably secured into a ring bound notebook.

When a pen is secured with a body of the pen inside the rings of the notebook, note FIG. 5 at sheet five, any tendency for interference to occur with the bound contents of the notebook is minimized. The trapezoidal segments 104 and 108 provide minimal interference with the bound contents, due to their shape, with sloping side edges while minimizing movement of the main body 102.

Referring to FIG. 1B, a main body of a writing apparatus or pen 122 and cap 124 for the pen are shown. The cap 124 contains the following: (1) a fitted segment 132 which is adapted for a friction fit around a writing end 126 of the main body 122 of the pen; (2) a first trapezoidal segment 134; (3) a hole 136 within the trapezoidal segment 134; and (4) a clip 142. The clip 142 allows the pen to be secured to various objects other than ring bound or spiral bound notebooks, such as shirt pockets, pages, etc. The hole 136 allows the cap 124 to be secured within a ring bound notebook by opening the binding, placing the hole 136 around one ring of the binding, and then closing the binding. The pen body and cap are thus secured with respect to the notebook and the pen can be withdrawn from the cap for conventional use and then replaced for carrying along with the notebook.

The main body of the pen 122 is secured into the cap 124 by a friction fit, thus, allowing the main body 122 to be secured to the cap. The main body 122 is also fitted with a trapezoidal segment 138 with a hole 140. This segment is positioned near a non-writing end 130 of the main body 122 of the pen. The hole 140 allows the main body 122 to be secured within a ring binding, while also being secured into the cap 124. Similar to the embodiment of FIG. 1A, the trapezoidal segments 134 and 138 minimize interference with other bound contents of a ring bound notebook when the cap 124 and main body 122 are positioned inside the ring binding, while providing increased security.

Figure 2B:
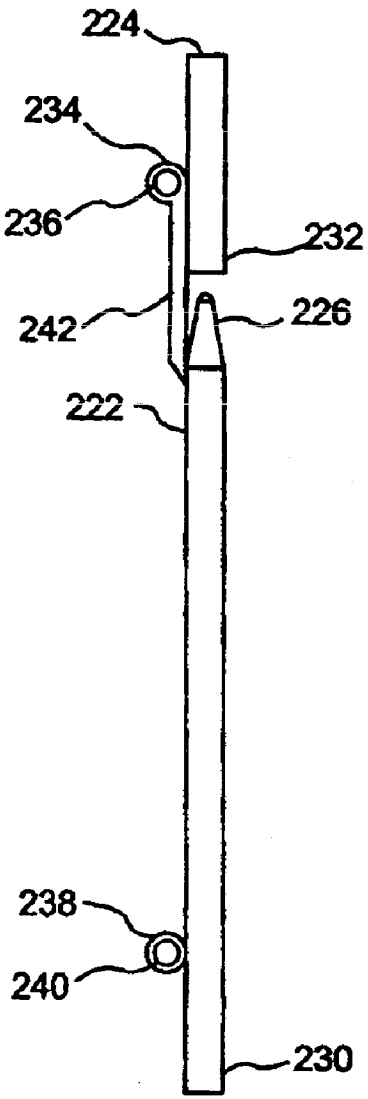
FIG. 2B illustrates a pen similar to the pen disclosed in FIG. 2A having a ring connected to, and extending from, a cap of a pen, and a similar ring connected to, and extending from, the main body of the pen, each device allowing the pen to be secured to either a spiral bound notebook or ring bound notebook.
Figure 2A:
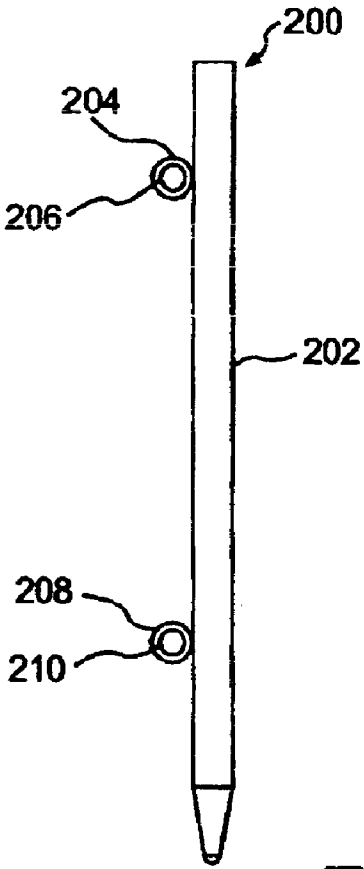
FIG. 2A illustrates another embodiment of the invention and discloses a pen having two securing rings connected to, and extending from, a main body of the pen, each ring allowing the pen to be secured to either a spiral bound notebook or ring bound notebook.

Referring to FIG. 2A, a writing apparatus or pen 200 is shown having two securing devices 204 and 208 connected to, and extending from, the main body 202 of the pen 200. A circular, non-writing end, securing device 204, with hole 206, and a writing end securing device 208, with hole 210, are similar in shape and function. The holes 206 and 210 allow the main body to be secured within a ring bound or spiral bound notebook (note FIGS. 5 and 6).

The securing devices 204 and 206 can be a clasp, a generally C-shaped retaining member (see FIGS. 3 and 4 to be discussed in detail below), or similar device that can be positioned around the binding of a notebook. When the non-writing end securing device 204 and writing end securing device 208 are both secured on a notebook binding ring and the main body 202 is positioned inside the binding ring, any interference with bound contents of the notebook is minimized. The circular securing devices 204 and 208 provide minimal interference with the bound contents, due to their size and shape, while minimizing movement of the main body 202.

Another embodiment of the invention is illustrated in FIG. 2B. In this, a main pen body 222 and cap 224 of a writing apparatus are shown. This particular embodiment is similar to the embodiment described in FIG. 1B. The cap 224 contains the following: (1) a fitted segment 232 which is adapted for a friction fit around the writing end 226 of the pen main body 222; (2) a ring segment 234, (3) a hole 236 within the ring segment 234; and (4) a clip 242. In this embodiment, however, the securing device 234, as opposed to being a flattened trapezoidal segment, protrudes from the side of the cap 224 as a ring and contains a hole 236.

In order to enhance securement and retention, a second securing device 238 protrudes from the main body 222 and contains a hole 240. As in the description of FIG. 1B, the respective holes 236 and 240 allow the cap 224 and main body 222 to be secured within a notebook similar to FIG. 5. However, this particular embodiment also allows the main body 222 and cap 224 to be secured to a spiral bound notebook, as well as a ring bound notebook, in a manner that will be discussed below.

In FIG. 1B and FIG. 2B a clip is utilized for securing the writing apparatus to objects other than a notebook, such as shirt pockets, pages, etc. However, the clip does not have to be included in the subject invention to secure the writing apparatus to a ring bound or spiral bound notebook.

FIGS. 1A and 2A do not include caps, but these particular embodiments can include caps. The cap has to be designed around the trapezoidal segment or securing device near the writing end of the pen.

Figure 3:
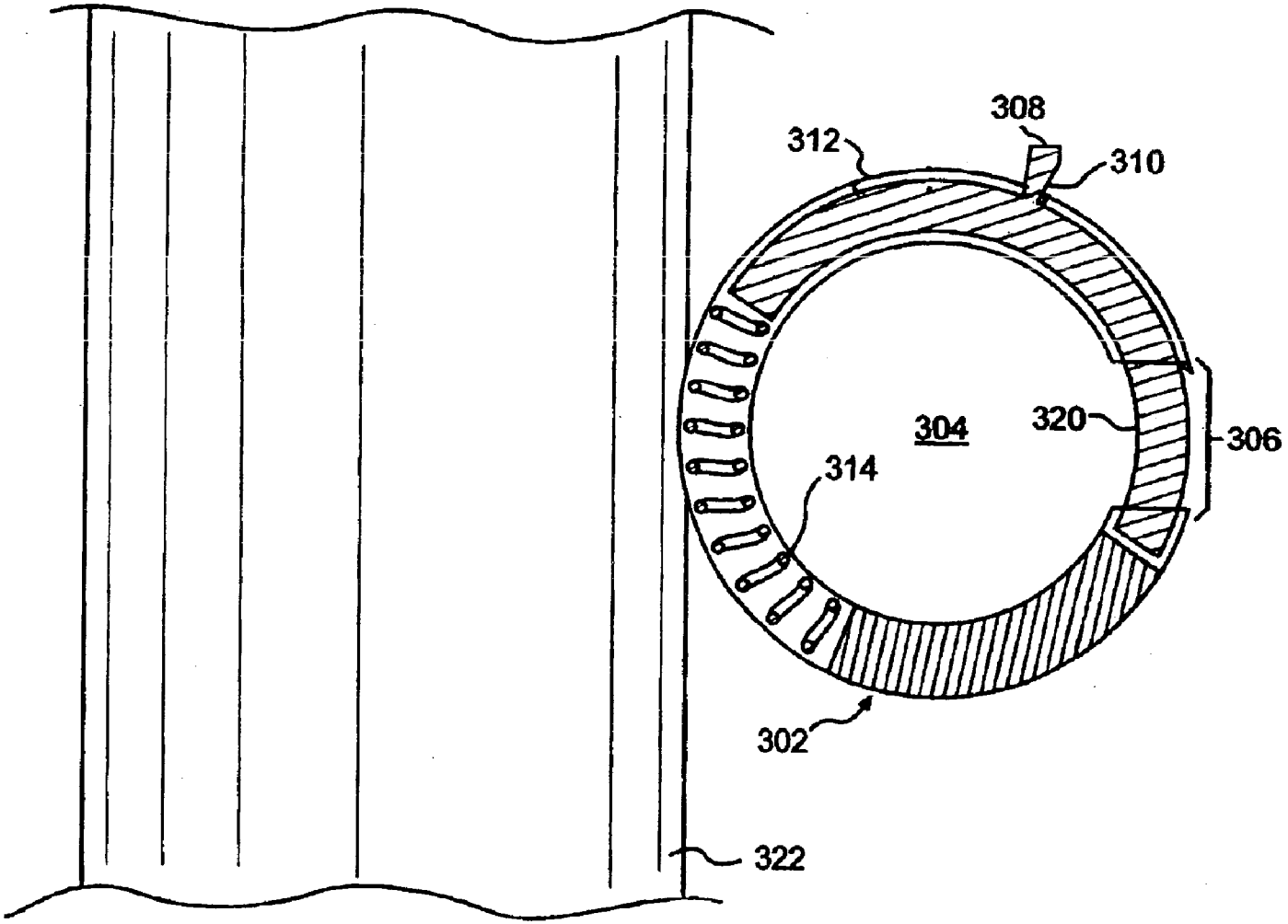
FIG. 3 comprises a partial detail view of one embodiment of a retaining member such as a ring as illustrated in FIGS. 2A and 2B allowing a pen or a cap of a pen to be secured or removed from a notebook binder.

Referring now to FIG. 3, a releasable clasp device 302 is shown forming an open hole 234 such as generally depicted in FIGS. 2A and 2B. The clasp device 302 may be present on a cap and/or the main body 322 of a writing apparatus, depending on the particular embodiment of the subject invention. The clasp device 302 allows the main body 322 or cap to be secured by creating and closing an opening 306 of sufficient radial length to allow access to the hole 304. The clasp device 302 is operable by a lever 308, allowing the opening 306 to be exposed. The lever 308 is connected to an arcuate element 320 that creates an encirclement of the hole 304 when the lever 308 is in a first or rest position 310. When the lever 308 is pushed away from its rest position 310, by a force compressing a spring 314, to the lever's second position 312, an opening 306 is created by the retracting element 320. This allows a notebook binding or spiral spine to be placed in the hole 304, and then secured by releasing the lever 308 from its second position 312 back to the rest position 310 by means of a spring 314, resulting in the element 320 closing off access through the opening 306 to the hole 304.

Figure 4:
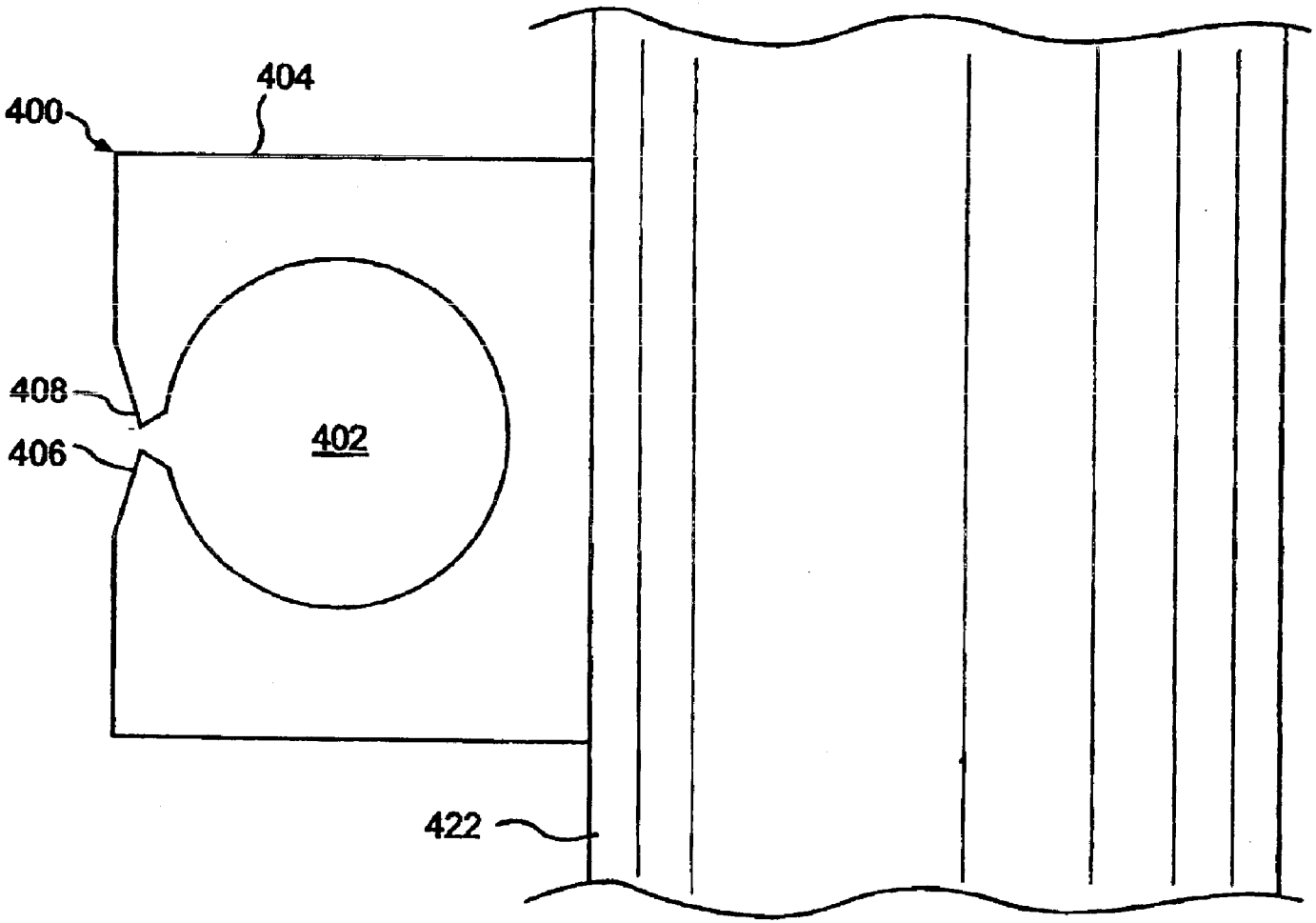
FIG. 4 is a partial detail view, similar in character to FIG. 3, and illustrates an alternative embodiment of a generally C-shaped retaining ring, allowing a pen and/or a cap of a pen to be secured or removed from a notebook binding ring.

Referring to FIG. 4, an alternative embodiment of a securing device is shown. In this embodiment, a generally C-shaped retaining member 400, is used. The retaining member 400 allows a writing apparatus and/or a cap of a writing apparatus to be secured or removed with respect to a notebook ring or spiral binding. The retaining member 400 is placed on the main body 422 and/or a cap of a pen, depending on the particular embodiment (see FIGS. 2A and 2B). The retaining member 400 comprises a molded segment 404, which is made of a plastic or other material having a degree of flexibility with a memory capacity for its original configuration. The molded segment 404 is comprised of two opposing entry points 406 and 408, which are in close proximity to each other and creating a hole 402 when the entry points are in a relaxed condition. When force is applied to the entry points 406 and 408, the flexibility of the molded segment 404 allows the binding to be pushed through or pulled out of the encircled hole 402.

Referring to FIG. 5, an illustration of a pen secured into a ring bound notebook in accordance with one embodiment of the invention is shown. In this, a pen 522 is secured into a typical ring bound notebook 502 by using the ring binding mechanism 504 to move a first ring 506 and a second ring 508 into an open position. Once the first ring 506 and second ring 508 are open, the pen 522 can be secured into the ring bound notebook 502 by simultaneously placing a hole 510 of a main body securing device 514, such as a flat trapezoidal segment, connected to a main body of the apparatus 520 around a first, C-shaped, spring ring 506, and placing a hole 512 of a second flat trapezoidal segment 516 connected to a cap 518 around a second, next adjacent, C-shaped, spring ring 508. The writing apparatus 522 will minimally interfere with notebook paper 502, when placed in a position inside the first ring 506 and second ring 508 of the notebook 500.

Other embodiments of a securable writing apparatus and securing devices, as described in FIGS. 1A–1B, are capable of similar operation. Furthermore, a securable writing apparatus or pen 522 does not have to be positioned on the inside of the ring binding 504 and may be positioned outside of the notebook rings 506 and 508, however, when the writing apparatus 522 is placed on the inside of the rings, it minimizes the amount of interference with the other contents of the notebook 500 due to the mass of the main body 520 and cap 518.

Figure 6:
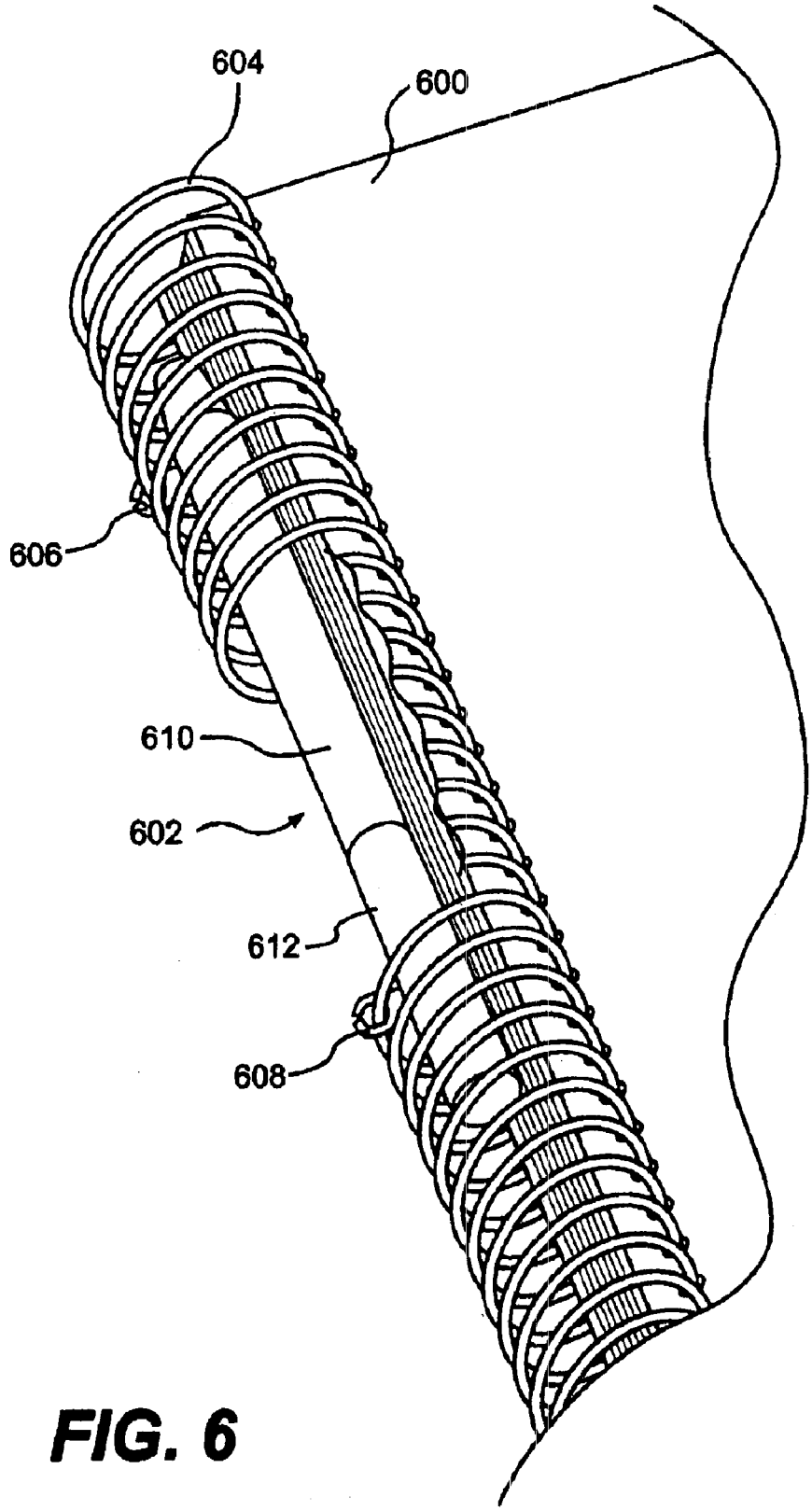
FIG. 6 illustrates a pen, such as illustrated in FIG. 4 releaseably secured into a spiral bound notebook spine.

Referring to FIG. 6, an illustration of a pen secured within a spiral bound notebook is shown. A securable writing apparatus 602 is secured into a spiral bound notebook 600 by positioning the writing apparatus 602 inside the spiral binding 604, and then positioning a first securing device 606, which is connected to the main body 610, around a ring of the spiral binding. In addition for enhanced securement a second securing device 608, which is connected to a cap 612, may be attached around a ring of the spiral binding.

The above description is only one example of how a securable writing apparatus 602 may be secured to a spiral bound notebook 600. Other embodiments of a securable writing apparatus and securing devices, as described in FIGS. 2A–2B, are capable of similar operation. Furthermore, a securable writing apparatus does not have to be positioned on the inside of the spiral binding 604, but may be positioned on the outside as well.

In the above description and in the claims that will follow the term securable writing apparatus or sometimes simply writing apparatus or pen is intended to be used in an open ended sense and as a generic expression or term for all writing instruments of various kinds such as ink pens, ball point pens, mechanical pencils, lead pencils, electronic wands, and the like that can function as writing instruments. Further in describing preferred embodiments of the invention the attachment members comprising a relatively flat trapezoidal member, a ring or a C-shaped member are all illustrated as being essentially manufactured with and a part of a body and/or cap portion of a writing instrument. However, those of skill in the art will also recognize that the attachment members can be connected to a collar or sleeve that is operable to slide over the body and/or cap of a writing instrument as an add-on element to a pen, pencil, electronic wand, etc. Moreover, it will be appreciated from the above description that one of such collars may be mounted onto or within a spiral or three ring binding to receive one end of a writing instrument while another end of the pen adjacent an end of the spiral binding carries an attachment member with the pen. In this embodiment a user is free to slide a pen with one attachment member on one end thereof into a spiral binding and insertion of a free end of the pen into the binding mounted attachment member while the other end of the pen, closer to the end of the spiral binding, is snapped into securement with the binding be the attachment member carried by the pen. In still another operative embodiment of the invention both of the attachment members, with pen receiving collars, may be mounted within a spiral, three ring or other type of binding member to be carried by the notebook and then a pen to be retained with the notebook is telescoped into engagement with a first one of the attachment members and then telescoped into the other attachment member wherein both attachment members are carried by the notebook.

In describing the invention, reference has been made to preferred embodiments. Those skilled in the art, however, and familiar with the disclosure of the subject invention, may recognize additions, deletions, substitutions, modifications and/or other changes which will fall within the purview of the invention as defined in the following claims.

What is claimed is:

1. A securable writing apparatus operable for attachment to a multi-ring notebook binder, said securable writing apparatus comprising;

a body portion of the securable writing apparatus;

a first attachment member connected to said securable writing apparatus, said first attachment member including at least one aperture;

a second attachment member connected to said securable writing apparatus, said second attachment member including at least one aperture, wherein said first and second attachment members being operable to attach to a multi-ring notebook binder with said first attachment member being releasably connected to one of the rings of a multi-ring binder and the second attachment member being releasably connected to another one of the rings of a multi-ring binder; wherein each of said first and second attachment members further comprises a ring with an aperture there through and a tangential portion of said ring being attached to said securable writing apparatus; and each of said first and second ring attach members comprises a generally C-shaped shell member having an open window and an arcuate telescoping member carried by said C-shaped member, said arcuate telescoping member being biased into a closed position, but operable to be slid against said bias into an open position, such that said arcuate telescoping member normally closes the open window in said C-shaped member.

2. A securable writing apparatus operable for attachment to a multi-ring notebook binder, said securable writing apparatus comprising;

a body portion of the securable writing apparatus;

a first attachment member connected to said securable writing apparatus, said first attachment member including at least one aperture;

a second attachment member connected to said securable writing apparatus, said second attachment member including at least one aperture, wherein said first and second attachment members being operable to attach to a multi-ring notebook binder with said first attachment member being releasably connected to one of the rings of a multi-ring binder and the second attachment member being releasably connected to another one of the rings of a multi-ring binder; wherein each of said first and second attachment members further comprises a ring with an aperture there through and a tangential portion of said ring being attached to said securable writing apparatus; and said first and second ring attachment members comprise a C-shaped member with flexible arms that essentially touch to create an enclosed ring and being operable to receive insertion of a ring of a binder into the ring through the flexible arms of said C-shaped member.

3. A method for securing a writing apparatus with respect to a multi-ring notebook binder wherein said method comprises the steps of:

fashioning a first securement attachment having an aperture onto a first portion of a writing apparatus;

fashioning a second securement attachment having an aperture onto a second portion of the writing apparatus;

engaging a first ring of a multi-ring notebook with the aperture of the first securement attachment; and engaging a second ring of a multi-ring notebook with the aperture of the second securement attachment; wherein said steps of fashioning comprises manufacturing the writing apparatus with said first securement attachment and said second securement attachment being an integral part of the writing apparatus.

4. A method for securing a writing apparatus with respect to a multi-ring notebook binder wherein said method comprises the steps of:

fashioning a first securement attachment having an aperture onto a first portion of a writing apparatus;

fashioning a second securement attachment having an aperture onto a second portion of the writing apparatus;

engaging a first ring of a multi-ring notebook with the aperture of the first securement attachment; and engaging a second ring of a multi-ring notebook with the aperture of the second securement attachment; wherein said steps of engaging comprises attaching a first securement attachment with a first ring of a multi-ring notebook;

telescoping one end of a writing apparatus into the first securement attachment attached to the first ring of the multi-ring notebook; and clipping the second securement attachment onto the second ring of the multi-ring notebook.

5. A method for securing a writing apparatus with respect to a multi-ring notebook binder wherein said method comprises the steps of:

fashioning a first securement attachment having an aperture onto a first portion of a writing apparatus;

fashioning a second securement attachment having an aperture onto a second portion of the writing apparatus;

engaging a first ring of a multi-ring notebook with the aperture of the first securement attachment; and engaging a second ring of a multi-ring notebook with the aperture of the second securement attachment; wherein said steps of engaging comprise the first ring and the second ring engaging separate lateral locations along a spiral ring notebook.

* * * * *

UNITED STATES PATENT AND TRADEMARK OFFICE

CERTIFICATE OF CORRECTION

PATENT NO. : 6,837,641 B2
APPLICATION NO. : 10/725487
DATED : January 5, 2005
INVENTOR(S) : Paul It is certified that error appears in the above-identified patent and that said Letters Patent is hereby corrected as shown below:

Title Pg, Item (76) INVENTORS: should read --Christopher P. Paul--

Signed and Sealed this

Thirteenth Day of March, 2007

JON W. DUDAS
*Director of the United States Patent and Trademark Office*

UNITED STATES PATENT AND TRADEMARK OFFICE

CERTIFICATE OF CORRECTION

PATENT NO. : 6,837,641 B2
APPLICATION NO. : 10/725487
DATED : January 4, 2005
INVENTOR(S) : Paul It is certified that error appears in the above-identified patent and that said Letters Patent is hereby corrected as shown below:

Title Pg, Item (76) INVENTORS: should read --Christopher P. Paul--

This certificate supersedes Certificate of Correction issued March 13, 2007.

Signed and Sealed this

Third Day of April, 2007

JON W. DUDAS
*Director of the United States Patent and Trademark Office*